US008549706B2

(12) United States Patent
Bultschnieder

(10) Patent No.: US 8,549,706 B2
(45) Date of Patent: Oct. 8, 2013

(54) DOOR HINGE FOR AN ENTRANCE DOOR

(75) Inventor: Andre Bultschnieder, Rheda-Wiedenbrueck (DE)

(73) Assignee: Simonswerk GmbH, Rheda-Wiedenbrueck (DE)

( * ) Notice: Subject to any disclaimer, the term of this patent is extended or adjusted under 35 U.S.C. 154(b) by 226 days.

(21) Appl. No.: 13/045,568

(22) Filed: Mar. 11, 2011

(65) Prior Publication Data

US 2011/0219696 A1 Sep. 15, 2011

(30) Foreign Application Priority Data

Mar. 13, 2010 (DE) ..... 10 2010 011 326

(51) Int. Cl.
*E05D 7/04* (2006.01)

(52) U.S. Cl.
USPC ..... 16/238; 16/235; 16/236

(58) Field of Classification Search
USPC ..... 16/235, 236, 237, 238, 239, 240, 241, 16/242, 243, 245, 246, 247, 248, 249
See application file for complete search history.

(56) References Cited

U.S. PATENT DOCUMENTS 2,885,722 A * 5/1959 Halliday ..... 16/237
4,304,027 A * 12/1981 Di Fazio ..... 16/249
5,694,665 A * 12/1997 Strickland et al. ..... 16/238
5,701,636 A * 12/1997 Jahnke ..... 16/238
5,752,291 A * 5/1998 Snyder ..... 16/235
5,755,011 A * 5/1998 Green et al. ..... 16/238
5,799,370 A * 9/1998 Davidian et al. ..... 16/236
7,331,085 B2 * 2/2008 Heid ..... 16/242
7,334,293 B2 * 2/2008 Erickson et al. ..... 16/243
7,350,272 B2 * 4/2008 Fries ..... 16/246
7,516,517 B2 * 4/2009 Fries ..... 16/246
7,552,511 B2 * 6/2009 Campbell et al. ..... 16/238
7,571,516 B2 * 8/2009 Lueffe et al. ..... 16/382
7,587,788 B2 * 9/2009 Heid ..... 16/242
7,676,887 B2 * 3/2010 Chung ..... 16/236
7,694,388 B2 * 4/2010 Campbell et al. ..... 16/239
7,694,389 B2 * 4/2010 Erickson et al. ..... 16/243
2004/0128794 A1 * 7/2004 Chung ..... 16/236

FOREIGN PATENT DOCUMENTS

DE 19921796 B 4/2000
DE 102004016769 A 10/2005
DE 102005039037 B3 * 6/2006

* cited by examiner

*Primary Examiner* — Jeffrey O Brien
(74) *Attorney, Agent, or Firm* — Andrew Wilford

(57) ABSTRACT

A door hinge has a knuckle defining a pivot axis, a pair of leaves extending from the knuckle and pivotal relative to each other about the axis, a housing fixable in a door jamb or door edge, and a holder in the housing and formed by a pair of bent sheet-metal brackets. Rivets secure together the brackets to form a cavity in which one of the leaves is engaged. A pair of rotatable and externally threaded spindles extend across the cavity and are threaded to the one leaf such that rotation of the spindles adjusts a position of the one leaf in the cavity relative to the holder.

10 Claims, 2 Drawing Sheets

DOOR HINGE FOR AN ENTRANCE DOOR

FIELD OF THE INVENTION

The present invention relates to a hinge. More particularly this invention concerns a door hinge for an entrance door.

BACKGROUND OF THE INVENTION

A typical door hinge for use on an entrance door has a pivot or knuckle from one side of which extends a leaf attached to the door jamb and from the other side of which extends a leaf fixed to the door so that the door can pivot relative to the jamb about a normally vertical axis. In DE 10 2004 016 769 one of the leaves is simply screwed to the door and the other leaf is formed as a comb and fitted to a holder in turn set in a housing recessed in the jamb. The holder can be shifted relative to the housing for adjustment of the hinge.

In line with known approaches, the housing is fastened to the door frame. The door hinge has a comb-like free hinge leaf that is inserted into the holder of the housing, which is fastened to the door jamb and is permanently fixed thereto. The holder has a fixing plate as well as a clamping plate and is guided on spindles. By turning the spindles, the position of the holder is modifiable relative to the housing that constitutes the mounting part. The constructive design allows the door to be adjusted from side to side, that is horizontally. In addition, the position of the hinge leaf can be corrected horizontally and vertically within the holder before the hinge leaf is secured in place in the desired position between the clamping plate and the fixing plate. The known housing requires a dimensionally stable support to mount the adjustment spindles. The fixing plate and clamping plate to secure the hinge leaf must be of solid construction to as to be able to hold the weight of the door. Construction of the housing is costly and requires an installation space with a depth of 22 to 25 mm.

DE 199 21 796 describes a door hinge with a holder for receiving a hinge tab clamped between a tensioning plate and a clamping plate of the holder. For position adjustment of the holder, a spindle is provided that extends through a recess of the hinge leaf without rotational contact.

Objects of the Invention

It is therefore an object of the present invention to provide an improved door hinge for an entrance door.

Another object is the provision of such an improved door hinge for an entrance door that overcomes the above-given disadvantages, in particular that is compact and inexpensive to manufacture, yet very rugged.

SUMMARY OF THE INVENTION

A door hinge has according to the invention a knuckle defining a pivot axis, a pair of leaves extending from the knuckle and pivotal relative to each other about the axis, a housing fixable in a door jamb or door edge, and a holder in the housing and formed by a pair of bent sheet-metal brackets. Rivets secure together the brackets to form a cavity in which one of the leaves is engaged. A pair of rotatable and externally threaded spindles extend across the cavity and are threaded to the one leaf such that rotation of the spindles adjusts a position of the one leaf in the cavity relative to the holder.

The adjusting spindles according to the invention extend through threaded holes of the hinge tab in the holder so its position is adjustable by rotating the adjusting spindles. According to the invention, the hinge tab is no longer fixed by a clamp within the holder but is an integral part of the holder. The weight of the door leaf is directly transmitted from the hinge tab to the threaded spindles and transferred into the holder which consists of the two brackets riveted to each other. By eliminating a clamp, the arrangement according to the invention is characterized by a very low construction height.

According to a preferred embodiment of the invention, the rivets of the brackets have internal threads and the holder is connected to the housing by screws that engage with the internal threads of the rivets. The fit of the screws into the rivets has the advantage that the rivets cannot deform and thus cannot lose their function.

The housing can be elongated and have boreholes for fastening screws and openings for the screws connected to the holder. The screws are dimensioned such that position corrections of the holder are possible in the vertical and transverse directions.

According to a preferred embodiment of the invention, the holder is also detachably connected to a back plate on its back face. This back plate, in particular, has forwardly projecting collars or holes provided with internal threads. The holder can be connected to the back plate by screws that extend through holes in the brackets as well as in the hinge tab and are screwed into the threaded collars. The openings are dimensioned such that position corrections of the holder relative to the back plate are possible. By tightening the screws, the holder can be braced with the back plate.

According to a preferred embodiment of the invention, the holder is connected on both ends to plate-shaped connection parts. On the front side of the connection parts, a continuous cover plate can be arranged which bridges the region of the holder.

Due to the compact configurations of the holder, the holder can be accommodated in a rabbet recess in the longitudinal narrow edge of the door. Thus, the invention is also the use of the above-described door hinge on a door having a door made of wood and a door frame, the holder of the door hinge being recessed in the narrow edge of the door and fastened to the door leaf, a second connection element of the door hinge being secured to the door frame. The door hinge can be used with a standardized structure of the holder for rabbeted doors and flush doors. Only the connection element on the frame sides is to be adapted and depends on the embodiment of the frame that can be made, for example, as a block frame, casing frame or steel frame.

BRIEF DESCRIPTION OF THE DRAWING

The above and other objects, features, and advantages is will become more readily apparent from the following description, reference being made to the accompanying drawing in which.

DETAILED DESCRIPTION

Figure 2:
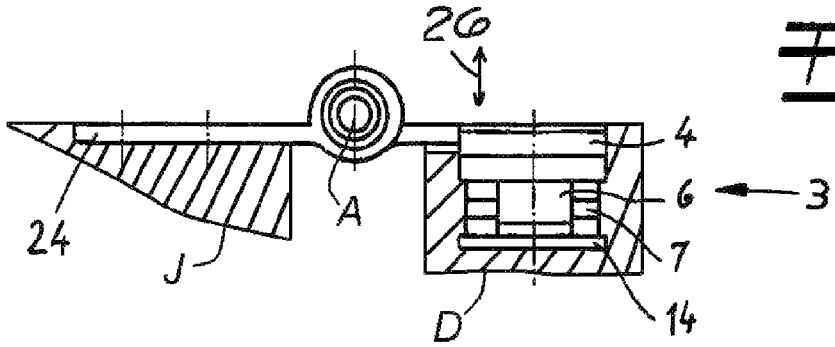
FIG. 2 is a top view of the hinge with part of the adjacent door and jamb structure shown.
Figure 1:
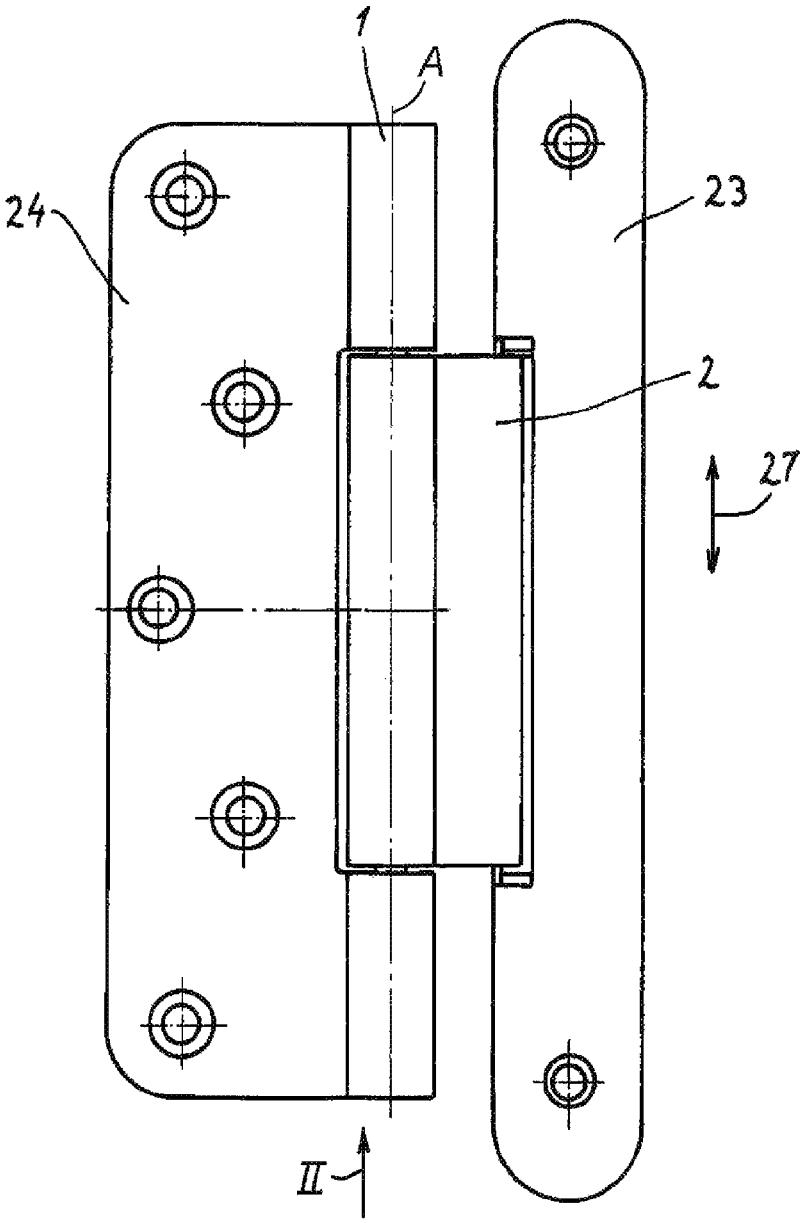
FIG. 1 is a front elevational view of the hinge in a full-open position.

As seen in FIGS. 1 and 2, a hinge according to the invention is used between a door jamb J and a door D, for pivoting of the door D relative to the jamb J about a vertical axis A parallel to the jamb J and plane of the door D. It comprises a housing 3 that is recessed in the edge of the door D and that has at its upper and lower ends cast-metal mounting parts 4 and 4' that are fixedly screwed to the door D above and below a holder 5 in which one tab or leaf 2 of the hinge is secured as will be described below. The leaf 2 is coupled at a knuckle or pivot 1 defining the axis A to another leaf 24 that is screwed to the door jamb J.

The holder 5 is formed by front and back elongated metal brackets 6 and 7 that are riveted together, that form a cavity 25 (FIG. 3) in which the leaf 2 engages, and between which two externally threaded adjustment spindles 8 are pivotally mounted for rotation about respective horizontal axes extending in a front-to-back direction 26. The spindles 8 are fitted through threaded holes of the hinge leaf 2 engaged in the cavity 25, with the result that the leaf's horizontal position in the holder 5 can be adjusted in the front-to-back direction 26 perpendicular to the axis A and parallel to the plane of the door D by turning the adjustment spindles 8 with, for instance, a hex wrench fitted to their outer ends.

Figure 3:
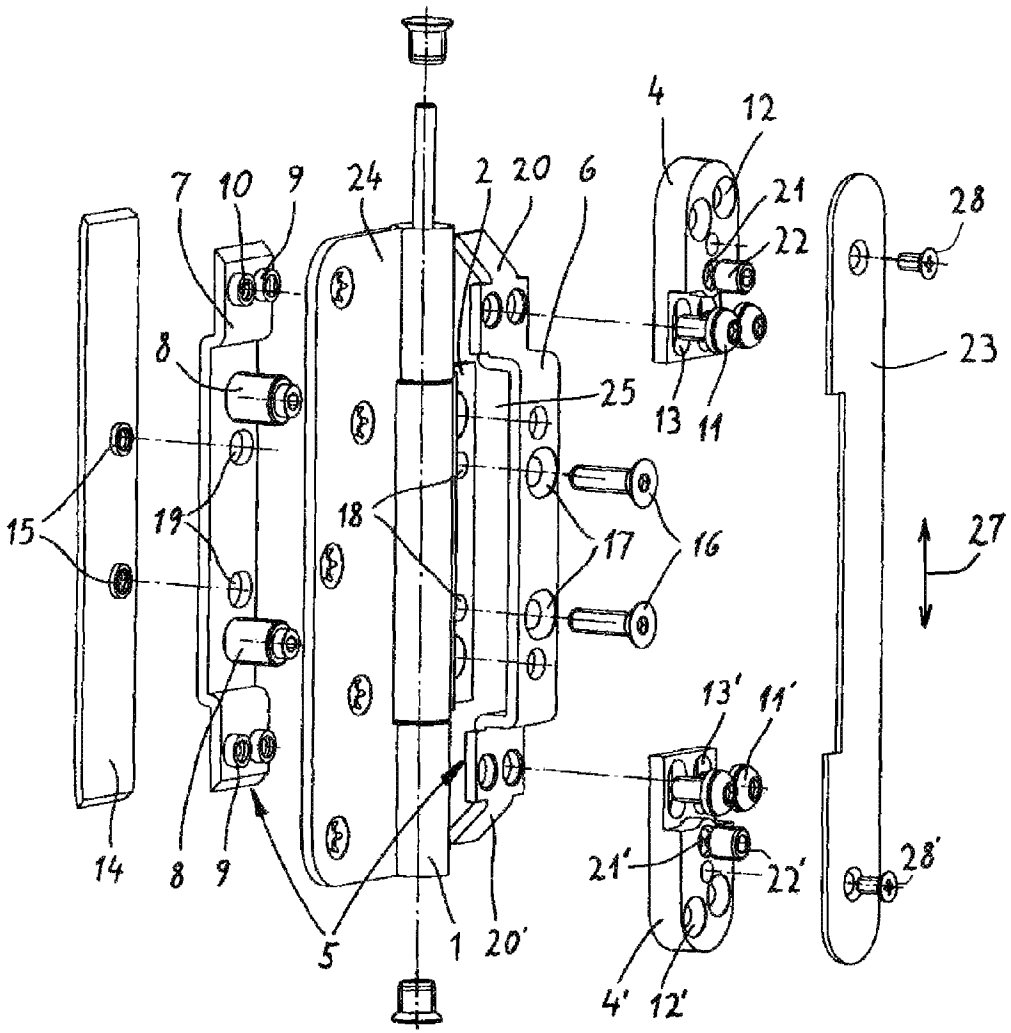
FIG. 3 is an exploded view of the hinge.

FIG. 3 shows how rivets 9 fixing together the brackets 6 and 7 are tubular and have internally threaded holes 10. The holder 5 is attached to the mounting parts 4 and 4' by screws 11 and 11' that are threaded into the holes 10 of the rivets 9. The screws 11 and 11' prevent the rivets 9 from deforming and losing their functionality, making it virtually impossible to separate the brackets 6 and 7 from each other.

The holder 5 formed by the brackets 6 and 7 is normally attached at both ends to the mounting parts 4 and 4', each of which has two drilled or punched holes 12 and 12' for unillustrated mounting screws that secure the parts 4 and 4' to the door edge and slots 13 and 13' for the screws 11 and 11' that are threaded into the rivets 9 of the holder 5. The slots 13 and 13' are vertically elongated in a direction 27 parallel to the axis A so as to enable corrections in the vertical position of holder 5. They could also be widened horizontally to allow side-to-side adjustment.

FIG. 2 shows that a back plate 14 is secured to a back face of the holder 5. The back plate 14 has forwardly directed, vertically spaced, and internally threaded collars 15, and the holder 5 is attached to the back plate 14 by screws 16 that pass in the direction 26 through holes 17 in the bracket 6, unthreaded guide holes 18 in the door leaf 2, and unthreaded holes 19 in the bracket 7 and are screwed into the collars 15. The holes 17, 18, 19 allow for vertical corrections (arrow 27) in the position of the holder 5 relative to the back plate 14 when the screws 16 are loosened. The screws 16 also act as guides permitting the leaf 2 to move in the front-to-back direction 26 perpendicular to the axis A relative to the holder 5, but lock it thereto against vertical movement in the vertical direction 27. Once in the desired position, the holder 5 can be locked in place by tightening the screws 16 in the back plate 14 to pull the ends of the back plate 14 forward against ends of the bracket 6 and by torquing down the screws 11 and 11' to lock the housing 3 to the holder 5. The additional screw attachment of the holder 5 to the back plate 14 improves the stability of the door hinge.

The brackets 6 and 7 forming the holder 5 are sheet-metal components fabricated by punching and bending, each having a straight and vertical central section, two short horizontal connecting sections extending from ends of the central section and forming therewith the cavity 25, and two straight and vertical end sections extending from the connecting sections and formed with holes for the screws 11. The front sheet-metal bracket 6 has angled end faces 20 and 20' formed by bending its sheet metal. The mounting parts 4 and 4' have internally threaded holes 21 and 21' in which respective set screws 22 and 22' engaging the respective angled end faces 20 and 20' of the sheet-metal bracket 6 are received. The adjustment screws 22 and 22' have conical ends that bear on the respective angled faces 20 and 20'. The position of the holder 5 in the housing 3 can be adjusted relative to the vertical direction 27 by loosening the screws 11, 11', and 16, then loosening, for example, the screws 22 and tightening the other screw 22'. This action will move the holder 6 up. Loosening the screw 22' and tightening the screw 22 will move it down. Once the desired vertical position is reached, the loosened screw 22 or 22' is tightened to lock in the vertical position of the holder 5 relative to the housing 3 and then the screws 11, 11', and 16 are tightened to lock all the parts solidly together in this position. The door hinge works equal for right- or left-hand doors.

A continuous and vertically elongated cover plate 23 is mounted on the front face of the mounting parts 4 and 4' covering the holder 5 when installed. Screws 28 and 28' secure the plate 23 to the parts 4 and 4' to form the housing 3. Normally the entire hinge assembly is installed with everything but the plate 23 in place. Then the spindles 8 are used to adjust the horizontal position of the door in the opening and the screws 22 and 22 adjusted for vertical positioning. The plate 23 is then installed to cover all the adjustment and mounting screws.

Due to its compact design, the housing 3 is well-suited for installation in the edge of a door. To this end, the housing 3 is inserted in a mortise in the narrow edge of the door and screwed in place through the holes 12 and 12'. The door-jamb leaf 24 in this embodiment is a flat plate that can be screwed flatly against the door frame. The design of the jamb leaf 24 is dependent on the door frame, and can also be composed of pins or other fastening means.

I claim:

1. A door hinge comprising:

a knuckle defining a pivot axis;

first and second leaves extending from the knuckle and pivotal relative to each other about the axis;

a housing fixable in a door jamb or door edge and formed with first and second throughgoing slots spaced apart along the axis, elongated parallel to the axis, and open perpendicular to the axis and with respective third and fourth threaded holes spaced apart along the axis and throughgoing perpendicular to the axis;

a holder in the housing and formed by a pair of bent sheet-metal brackets forming two end faces extending at an acute angle to the axis and respectively aligned with the third and fourth threaded holes;

rivets securing together the brackets to form a cavity in which the first leaf is engaged;

respective first and second screws extending through the slots transversely of the axis and seated in the holder, the first and second screws being tightenable to fix the holder against movement parallel to the axis in the housing and being loosenable to permit such movement;

respective third and fourth screws seated in the third and fourth holes and engageable with the end faces, whereby tightening of one of the third and fourth screws against the respective end face and loosening of the other of the third and fourth screws away from the respective end face shifts the holder in the housing parallel to the axis; and a pair of rotatable and externally threaded spindles extending across the cavity and threaded to the first leaf such that rotation of the spindles adjusts a position of the first leaf in the cavity relative to the holder.

2. The door hinge defined in claim 1 wherein the holder has a back plate and the brackets lie between the back plate and the housing.

3. The door hinge defined in claim 2 wherein the back plate is formed with threaded holes and the first leaf is formed with respective holes aligned with the threaded holes, the hinge further comprising fifth and sixth screws each extending through the holder parallel to the spindles, through a respective one of the holes of the first leaf, and threaded into a respective one of the holes of the back plate for securing the back plate to the holder, the first leaf being displaceable parallel to the fifth and sixth screws in the cavity.

4. The door hinge defined in claim 3 wherein the housing is formed by a pair of end parts flanking the holder and a front plate secured to the end parts and overlying the holder.

5. The door hinge defined in claim 4, further comprising:

seventh and eighth screws securing the front plate to the end parts.

6. The door hinge defined in claim 4 wherein the first and second screws extend through the end parts into the holder.

7. An assembly comprising:

the hinge of claim 1;

a door having a narrow edge in which the housing and holder are recessed; and a door jamb to which the second leaf is secured.

8. A door hinge comprising:

a knuckle defining a pivot axis;

first and second leaves extending from the knuckle and pivotal relative to each other about the axis;

a housing fixable in a door jamb or door edge;

a holder formed by a pair of bent sheet-metal brackets and shiftable in the housing in a first direction;

rivets fixing together the brackets to form a cavity in which the first leaf is engaged;

a pair of rotatable and externally threaded spindles extending across the cavity and threaded to the first leaf to each side of the cavity such that rotation of the spindles adjusts a position of the first leaf in the cavity relative to the holder in a second direction transverse to the first direction; and means engaged between the holder and the housing for shifting the holder in the housing in the first direction.

9. The door hinge defined in claim 8, wherein the means is a pair of screws threaded into the housing and bearing on the holder.

10. The door hinge defined in claim 9, wherein the holder has ends angled to the first and second directions and the screws extend in the first direction and bear on the angled ends of the holder.

* * * * *